US006402422B1

(12) United States Patent
Gertz et al.

(10) Patent No.: US 6,402,422 B1
(45) Date of Patent: Jun. 11, 2002

(54) LATERALLY STABLE VERTICAL PANEL SYSTEM

(75) Inventors: David C. Gertz, San Clemente; Jack H. Kulp, San Juan Capistrano, both of CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

(21) Appl. No.: 09/247,217

(22) Filed: Feb. 10, 1999

(51) Int. Cl.[7] ..... E01F 9/018
(52) U.S. Cl. ..... 404/9; 404/6; 116/63 P
(58) Field of Search ..... 404/6, 9, 10; 116/63 P, 116/63 R; 340/908.1

(56) References Cited

U.S. PATENT DOCUMENTS

| | | | | | |
|---|---|---|---|---|---|
| 4,596,489 | A | | 6/1986 | Mariol et al. | |
| 4,792,258 | A | | 12/1988 | Goff | |
| 5,165,818 | A | * | 11/1992 | Newhart | 404/10 |
| 5,267,523 | A | * | 12/1993 | Hugron | 116/63 R |
| 5,484,225 | A | * | 1/1996 | Warner | 404/9 |
| 5,551,370 | A | | 9/1996 | Hwang | |
| 5,670,954 | A | * | 9/1997 | Junker | 340/908.1 |
| 5,703,577 | A | | 12/1997 | Carter | |
| 5,860,386 | A | * | 1/1999 | Schwab et al. | 116/63 P |

FOREIGN PATENT DOCUMENTS

| | | | | |
|---|---|---|---|---|
| DE | 3718440 A1 | * | 12/1988 | E01F/9/01 |
| WO | WO-90/01583 | * | 2/1990 | E01F/9/01 |

OTHER PUBLICATIONS

Traffix Devices Product Guide, pp. 15, Apr. 1998, TrafFix Devices, Inc., San Clemente, CA.

Standfix Flat Cone Product Brochure, pp. 1–8, May 1997, American Transportation Equipment, Inc., Industry, CA.

Windbreakers Non–nmetallic Channelizing Device; Trafcon Industries Inc.; Patent Pending, No date.

Big Food Self Ballasting Vertical Chanelizer; Protection Services Inc. a Division of Stabler Companies inc.; 11/95.

DDK Barricade; What Makes DDK The Best?; Service L.C., Cedar Falls Iowa, No date.

Ilmpact Recovery Systems; Flexible Traffi Control Producst; San Antonio Texas, No date.

* cited by examiner

*Primary Examiner*—Thomas B. Will
*Assistant Examiner*—Alexandra K. Pechhold
(74) *Attorney, Agent, or Firm*—Stout, Uxa, Buyan & Mullins, LLP; Donald E. Stout

(57) ABSTRACT

A vertical panel system has a vertical panel and a base. The vertical panel has one or more panels. Each panel has opposing first and second panel surfaces and a plurality of edges, wherein the plurality of edges has a base edge. A tab extends from the first panel base edge and terminates at a tab bottom edge. The tab has two opposing side surfaces extending between two opposing side edges. At least one of the tab side surfaces has a tab groove extending from the tab bottom edge and towards the first panel base edge. The base has a top surface and a slot extending from the top surface and into the base. The slot complements at least a portion of the tab and the tab groove. The tab bottom edge extends a length that is shorter than the length of the panel base edge. When assembled, a portion of the vertical panel is in contact with the base top surface, which stabilizes the vertical panel laterally. The edges of vertical panel are raised to protect the panel surfaces. The raised surfaces may have reflective sheeting disposed thereon or may comprise reflective material. There may also be a second panel in the vertical panel. The vertical panel system may meet the requirements of Type I and II barricades.

30 Claims, 3 Drawing Sheets

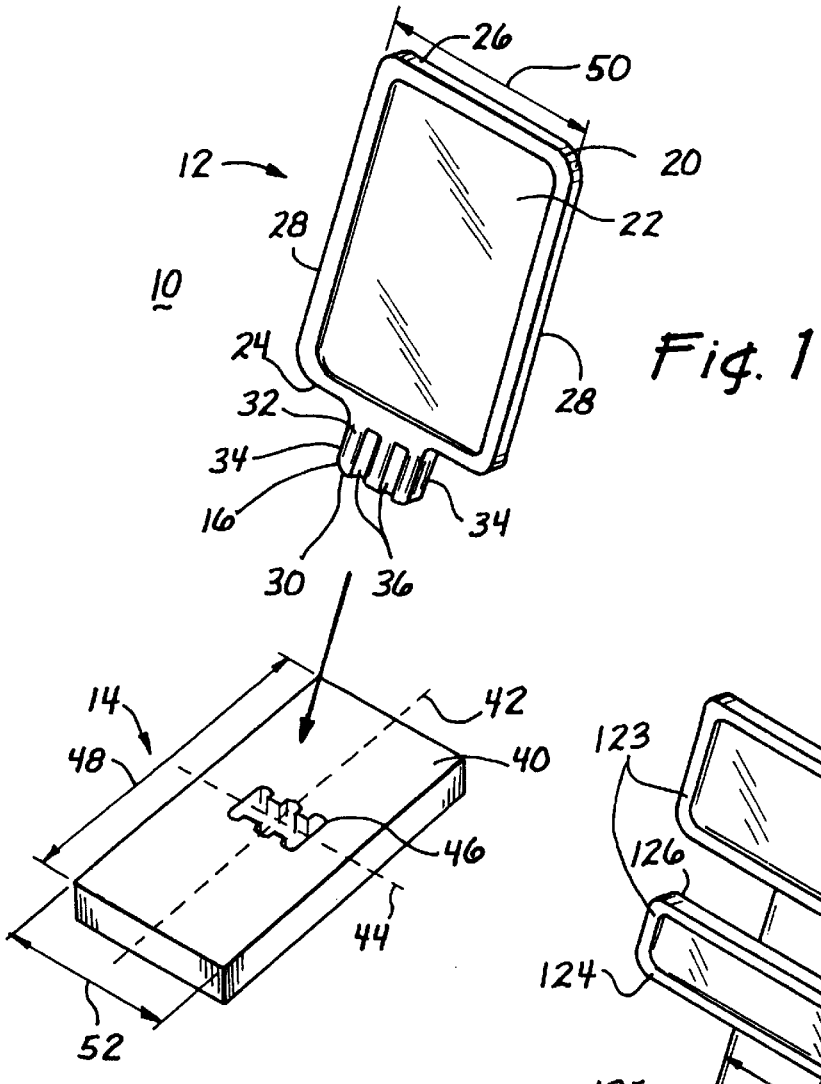
Fig. 1
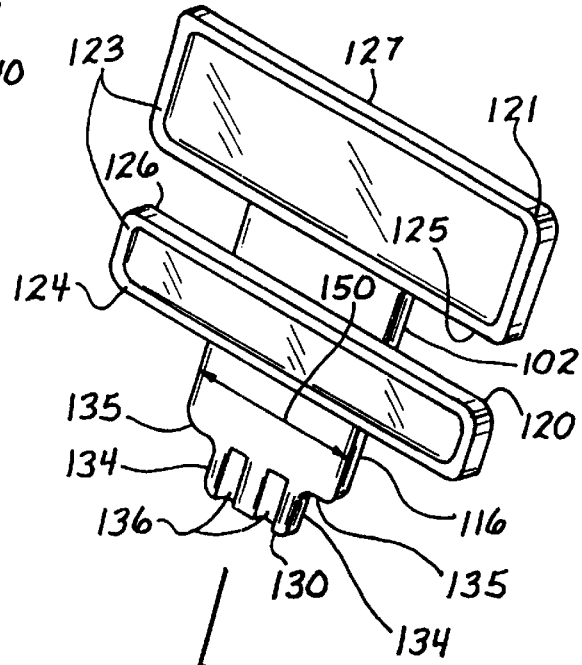
Fig. 4
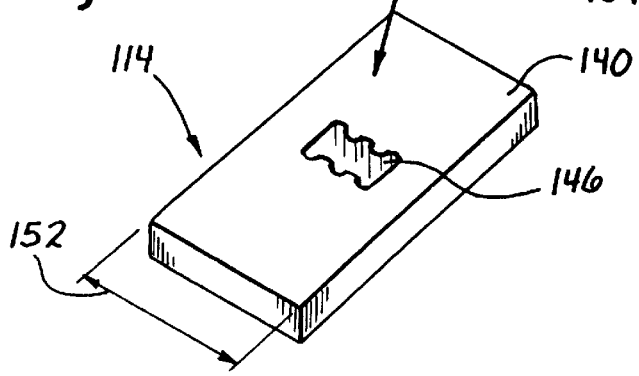

LATERALLY STABLE VERTICAL PANEL SYSTEM

BACKGROUND OF THE INVENTION

1. Field of the Invention

This invention relates to traffic safety devices and, more specifically, to vertical panels.

2. Description of the Related Art

Highway signs are generally used for promoting the safe passage of motor vehicles and/or pedestrians by advising of, for example, approaching unsafe driving conditions. These highway signs are generally provided with various highway legends, and are generally configured to flex in response to prevailing winds and wind gusts created by motor vehicles and the like.

It is known in the art to use a vertical panel system as a highway sign. In a typical vertical panel system, a vertical panel is on a collapsible support so that it folds down when impacted by a vehicle. This mitigates damage to the panel and the vehicle. A common example is an A-frame design consisting of two sides which are hinged together at the top. Each side has a panel attached to it. For support, the A-frame design is weighed down by sandbags. Upon impact, the A-frame folds flat. This design, while simple to build, is relatively unpredictable and requires at least two components, the A-frame and a sandbag, and maybe more than one sandbag.

An improvement on this idea is disclosed in U.S. Pat. No. 4,792,258 to Goff entitled "Collapsible Warning Barricade Apparatus" ("Goff"), which is incorporated wherein in its entirety. Goff discloses a vertical panel pivotally attached to a base. The panel was maintained in a position, such as vertical, with the use of a compression spring device that exerted a force on an automatic locking means at the pivot point. The automatic locking means has multiple elements that coordinated to maintain the panel in an upright position until impact. Unfortunately, the design as disclosed in Goff is complicated to build and requires many parts.

It is also a problem with vertical panel systems that when they are impacted, the systems are dragged with the vehicle. As the base or support of the system is attached to the panel, both the panel and the base are damaged. Further, as the vehicle is dragging both the panel and the base, the vehicle incurs increased damage than if the panel was being dragged alone.

The prior art discloses a vertical panel system with a breakaway safety feature such that the panel separates from the base when impacted. This system is available under the trade name WindBreakers from Trafcon Industries Inc, 81 Texaco Road, Mechanicsburg, Pa. 17055. The WindBreakers' panel is attached to the rubber base via a breakaway pin that is inserted through the width of the panel. A disadvantage of the WindBreaker is that a replacement pin must be used to reattached the panel to the base as the original pin shears upon separation. Another disadvantage is that the WindBreaker panel flexes in the wind. And additional disadvantage is that the panel does not easily release to stack the bases and panels flat.

Therefore, it is desirable to have a vertical panel system which is collapsible upon impact, the panel is separable from the base during impact, is easily stacked, and made from relatively few parts. It is also desirable to have a panel that can be reattached to the base without replacing parts. It is also desirable to have the panel surface protected from scratches and mars while it is being hit or dragged. It is also desirable to have a panel that does not flex from the wind force.

SUMMARY OF THE INVENTION

In an aspect of the invention, a vertical panel system has a vertical panel and a base. The vertical panel has comprising a first panel with opposing first and second panel surfaces and a plurality of edges, wherein the plurality of edges comprise a base edge. A tab extends from the first panel base edge and terminates at a tab bottom edge. The tab comprises two opposing side surfaces extending between two opposing side edges. At least one of the tab side surfaces has a tab groove extending from the tab bottom edge and towards the first panel base edge. The base has a top surface and a slot extending from the top surface and into the base. The slot may extend through the base or only partially through the base. The slot complements at least a portion of the tab and the tab groove.

In further aspects of the invention, the tab comprises a plurality of tab grooves extending from the tab bottom edge and towards the panel base edge on both tab side surfaces and the slot complements the tab portion and the plurality of tab grooves.

In a further aspect of the invention, the tab bottom edge is shorter than the panel base edge.

In a further aspect of the invention, the tab portion is disposed in the slot and a portion of the panel base edge is in contact with the base top surface.

In a further aspect of the invention, the tab comprises shoulder portions that laterally extend from the tab side edges. When the tab portion is disposed in the slot, the tab shoulder portions are in contact with the base top surface.

In a further aspect of the invention, at least a portion of the plurality of edges of the panel is raised above the first panel surface of the panel. In additional aspects of the invention, at least one of the panel surfaces are recessed.

In a further aspect of the invention, at least one of the panel surfaces is reflective. It may be reflective because reflective material, such as sheeting, is disposed on the panel surface. It may be reflective because the panel or the panel surface comprises reflective material.

In an aspect of the invention, the base is rubber. In another aspect of the invention, the base is a ballast-containing hollow plastic container. In an aspect of the invention, the vertical panel comprises double wall blow molded plastic.

In an aspect of the invention, the vertical panel comprises at least two panels that are connected by a support structure. In a further aspect of the invention, the panels define a plane. Either or both of the panels may have raised edges that protect one or more of the panel surfaces. The panel surfaces may be reflective. The vertical panel system may be a Type I or Type II barricade. The panel surfaces may be recessed.

In still another aspect of the invention, there is provided a vertical panel system which comprises a vertical panel having a panel with opposing first and second panel surfaces and a plurality of edges. The plurality of edges include a base edge. A projection, or tab, extends from the panel base edge and terminates at a bottom edge of the projection. The projection comprises two opposing faces extending between two opposing side edges.

Preferably, the projection is fabricated of a molded material, such as plastic, wherein the molded material includes surface irregularities molded therein.

The inventive system further comprises base which comprises a top surface and a slot extending downwardly from the top surface into the base. The slot is shaped to complement at least a portion of a shape of the projection, which is insertable into the slot to releasably attach the vertical panel to the base, such that when the vertical panel system is impacted by a vehicle, the vertical panel detaches and breaks away from the base.

Importantly, the base slot comprises an interior surface which includes surface irregularities the complement the surface irregularities of the projection. In a preferred embodiment, the surface irregularities of the projection comprise at least one groove, and the surface irregularities of the slot comprise at least one ridge which interfits with the at least one groove when the projection is inserted into the slot. The groove does not extend entirely through the slot.

Even more preferred is an embodiment where the at least one groove comprises a plurality of adjacent grooves, at least two of which are disposed on each face of the projection. Of course, in this embodiment, the surface irregularities of the slot comprise a plurality of ridges disposed on opposing portions of the interior surface of the slot. The ridges are arranged to interfit with corresponding projection grooves when the projection is inserted into the slot.

The invention, together with additional features and advantages thereof, may best be understood by reference to the following description taken in conjunction with the accompanying illustrative drawing.

BRIEF DESCRIPTION OF THE DRAWINGS

FIG. 1 shows an exploded perspective view of a vertical panel system with one panel according to an embodiment of the invention;

FIG. 4 shows an exploded perspective view of a dual vertical panel system according to an embodiment of the invention;

DESCRIPTION OF THE PREFERRED EMBODIMENTS

Figure 2:
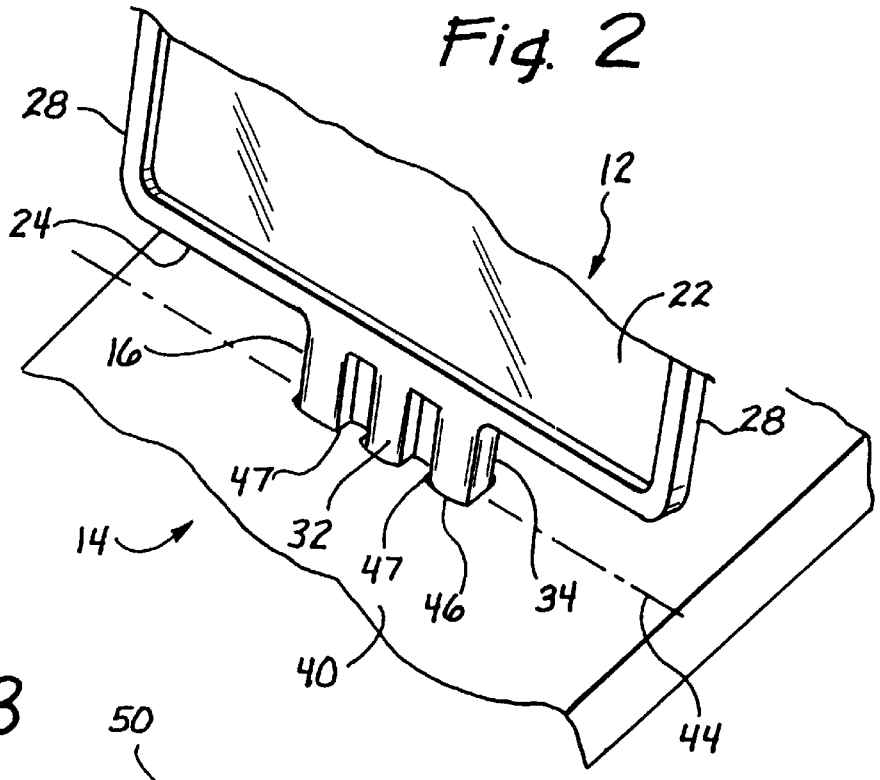
FIGS. 2 and 3 show details of assembly of the vertical panel system of FIG. 1.

Referring now to the figures, wherein like reference numerals refer to like elements throughout the figures, and referring specifically to FIG. 1, a vertical panel system according to an embodiment of the invention comprises a vertical panel 12 and a base 14. When a tab 16 extending from the vertical panel 12 is inserted into a slot 46 in the base 14, the assembled vertical panel system 10 resembles an inverted T with the base 14 being the cross member. The vertical panel system 10 is designed to remain standing in wind and gusts from bypassing vehicles while being able to separate into the panel 12 and base 14 upon impact. By the vertical panel system 10 being able to separate, the damage to the impacting vehicle and the system is mitigated.

The vertical panel 12 is comprised of a panel 20 with opposing panel first and second surfaces 22 (only one panel surface shown). The panel 20 has a base edge 24 proximate to the base 14 and from which the tab 16 extends. The panel 20 also has a top edge 26 that opposes the base edge 24 and is located distal to the base 14. Two opposing side edges 28 of the vertical panel 12 extend between top edge 26 and the base edge 24.

In a preferred, and shown, embodiment of the invention, the edges 24, 26, and 28 are raised above the panel surfaces 22. Some embodiments of the invention may be better regarded as the first and second panel surfaces 22 being recessed into the panel 20. By having the edges 24, 26, and 28 raised, the edges get scraped rather than the panel surfaces 22 or anything on the panel surfaces. Examples of causes of scraping includes the system 10 being struck or the panel 22 skidding across the ground. The panel surfaces 22 may be reflective, either by having reflective material, such as sheeting, disposed thereon or the panel surfaces comprise reflective material. The panel surfaces 22 may have other indicia thereon. Whether it is reflective material or other indica on the panel surfaces, it is protected by the raised edges 24, 26, and 28.

In a preferred embodiment of the invention, the raised edges 24, 26, and 28 extend normal to the panel surfaces 22. Other embodiments of the invention may have the raised edges 24, 26, and 28 that extend above the panel surfaces in a direction other than normal to the panel surfaces. In an embodiment of the invention, only a portion of the edges 24, 26, and 28 may be raised. In another embodiment of the invention, the edges 24, 26, and 28 may be raised above only one of the panel surfaces. The edges 24, 26, and 28 may be integral to the panel 20 or may be a separate but attached component of the panel 20.

In the shown embodiment of the invention, the vertical panel 20 is rectangular. Other embodiments of the invention may have vertical panels of other shapes. In the preferred embodiment of the invention, the vertical panel 12 is comprised of double wall blow molded plastic. Other embodiments of the invention may have a vertical panel comprised of other materials.

The tab 16 extends from a base edge 24 of the panel 20 and terminates at a tab bottom edge 30. The tab 16 comprises two opposing side surfaces 32 (only one side surface is shown) that extend between two opposing side edges 34. Each of the tab side surfaces 32 have two tab grooves 36 extending from the tab bottom edge 30 and towards the panel base edge 24. In the preferred and shown embodiment of the invention, the tab bottom edge 30 is parallel to the panel base edge 24 and the tab grooves 36 extend perpendicularly to the bottom edge and the base edge. Other embodiments of the invention may have other relationships between edges 24 and 30 and the tab grooves 36. The tab bottom edge 30 extends a length 31 that is shorter than the width 50 of the panel base edge 24.

In other embodiments of the invention, only one of the tab surfaces 32 may have tab grooves 36. In other embodiments of the invention, there may be more or less than two tab grooves 36 on a tab side surface 32. In the shown embodiment of the invention, the tab grooves 36 have a U-shaped profile (see FIG. 2). Other embodiments of the invention may have tab grooves with other suitable profiles. In the shown embodiment of the invention, the tab 16 and the panel 20 reside in essentially the same plane. In other embodiments of the invention, the tab 16 may be oriented at a different angle to the panel 20, such as a plane extending through the tab side edges 34 defines a plane that is normal to the panel 20. In the shown embodiment of the invention, the panel 20 has one tab 16. Other embodiments of the invention may have more than one tab. In the shown embodiment of the invention, the tab 16 is of a rectangular cube shape. Other embodiments of the invention may have tabs of other shapes. In the shown embodiment of the invention, the tab 16 is integral to the panel 20. Other embodiments of the invention may have the tab 16 attached to the panel 20.

The base 14 has a top surface 40, a major axis 42 extending along the length of the base and a minor axis 44 extending along the width of the base. At the intersection of the axes 42 and 44 is a slot 46. The slot 46 extends from the top surface 40 and into the base 14. The slot 46 complements the tab 16 and the tab grooves 36. The fit of the slot 46 with the tab 16 may be loose, snug, and it may be an interference fit. The interference fit of the slot 46 and the tab 16 may be in embodiments of the invention in which the base is made of an elastomeric material, such as rubber. The slot 46 may extend through the base 14 or terminate in the base.

To assemble the vertical panel system 10, the tab 16 is inserted into the slot 46. In the shown embodiment of the invention, the vertical panel 12 is oriented along the minor axis 44. Other embodiments of the invention may have the vertical panel oriented in other directions.

In the shown embodiment of the invention, the base 14 has a length 48 that is long enough to inhibit the vertical panel system 10 from tumbling in the direction of the major axis 42 when wind or gusts catches the vertical panel 20. The panel base edge 24 extends a width 50 that is substantially equal to a width 52 of the base 14.

Figure 3:
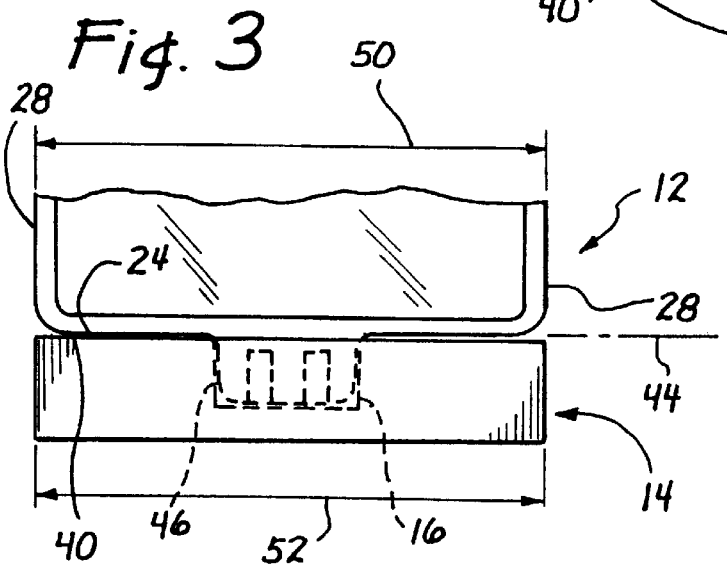

Referring now to FIGS. 2 and 3, the tab 16 is shown partially and fully inserted into the slot 46, respectively. The complementing slot 46 is shown with projections 47 extending into the grooves 36 in FIG. 3. It is clearly shown in FIG. 3 that the width 50 of the panel 20 is approximately the same of the width 52 of the base 14. Further, when the tab 16 is fully inserted into the slot 46, the base edge 24 of the panel 20 is in contact with the upper surface 40 of the base 14 across the width 52 of the upper surface. This contact provides a stable fitting of the vertical panel 12 and the base 14 that resists the tab 16 from coming out of the slot 46 through repeated lateral movements of the vertical panel 12 in the direction of the minor axis 44.

The base 14 is made of rubber in a preferred embodiment of the invention. The rubber base 14 provides ballast for the system 10 to inhibit tipping or moving the system while in use. Other embodiments of the invention may use any suitable ballasting type device as a base, such as a hollow plastic container filled with sand or another ballast or a frame that is secured in place with sand bags.

Referring now to FIG. 4, a dual paneled vertical panel system 100 has a vertical panel 112 with a lower panel 120 and an upper panel 121 that is mounted in a base 114. In the shown embodiment, the panels 120 and 121 define a plane. Other embodiments of the invention may have the panels 120 and 121 at a different orientation.

The panels 120 and 121 have raised edges 123. A base edge 124 of the lower panel 120 is located distal to a top edge 127 of the upper panel 121. A top edge 126 of the lower panel is located proximate to the base edge 125 of the upper panel 121. A support member 102 extends between the lower panel top edge 126 and the upper panel base edge 125. The support member 102 may be unitary with the two panels 120 and 121 or may be attached to the panels. Other embodiments of the invention may have different arrangements for the support member, including a plurality of support members or a support member that supports the two panels other than extending between the edges 125 and 126.

A tab 116 extends from the base edge 124 of the lower panel 120. The tab 116 has tab grooves 136, tab side edges 134, and a bottom edge 130 much like the tab grooves 36, tab side edges 34 and a bottom edge 30 of the vertical panel system 10. Additionally, tab 116 has shoulder portions 135 that laterally extend from the tab side edges 134. The shoulder portions 135 result in the tab 116 expanding to a width 150 as it approaches the lower panel. In a preferred embodiment of the invention, the width 150 is approximately the same as the width 152 of the base 114.

Figure 5:
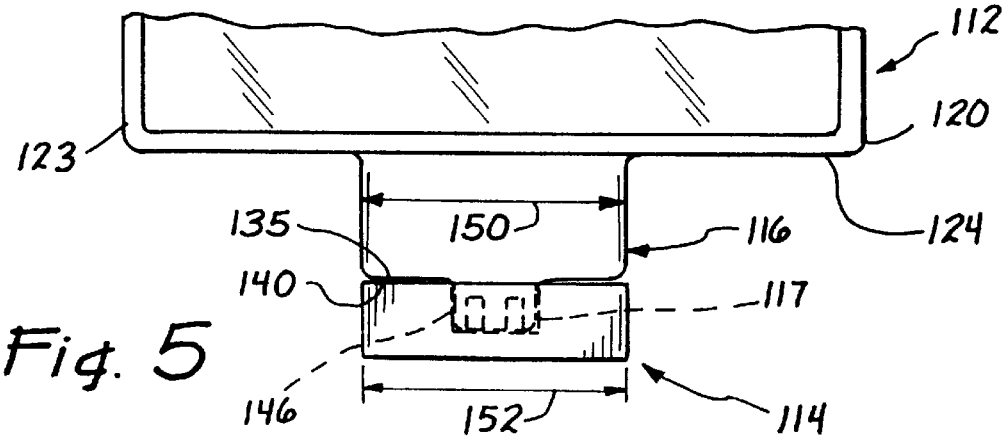
FIG. 5 shows details of assembly of the vertical panel system of FIG. 4.

Referring now to FIG. 5 as well, only a lower portion 117 of the tab 116 is inserted in a slot 146 of the base 114 when the system 100 is assembled. The tab lower portion 117 extends between the tab bottom edge 130 to the shoulders 135. FIG. 5 more clearly shows that the width 150 of the tab 116 is approximately the same as the width 152 of the base 114. This results in the shoulder 135 making contact with the base upper surface 140 across the width 152 of the base 114. The contact provides a very stable assembled system 100 as previously described in connection with the base edge 24 making contact with the base 14.

In an embodiment of the invention, panel surfaces are sized and positioned to conform to Type I or Type II barricade requirements. More specifically, the reflective sheeting requirements of the Type I or Type II barricades are mounted to appropriately sized and positioned panel surfaces in a vertical panel system that embodies the invention.

Figure 6:
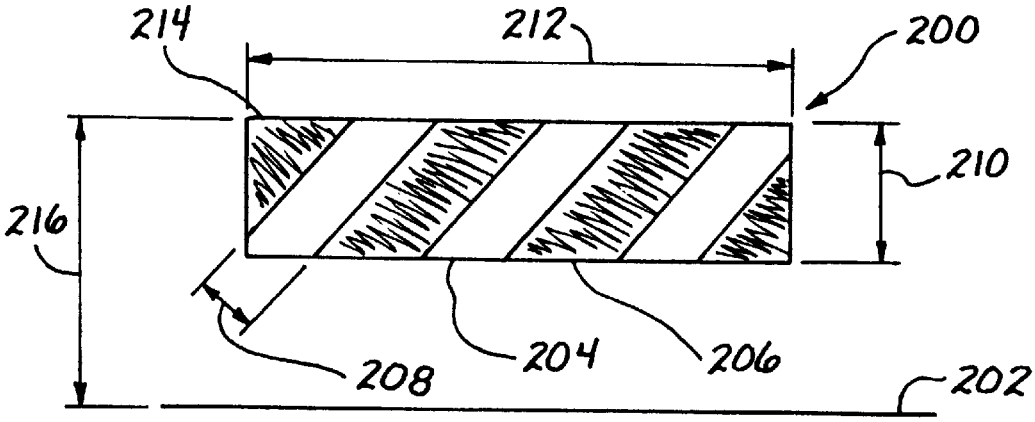
FIGS. 6 and 7 show details and positioning of reflective portion of Type I and Type II barricades, respectively.

Referring now to FIG. 6, the size and positioning of a reflective portion 200 of a Type I barricade is shown relative to the ground 202. The reflective portion 200 has white stripes 204 that alternate with orange strips 206. The stripes 204 and 206 lean to the right at a 45 degree angle and have a width 208 of six inches. Other reflective portions of Type I barricades may have the stripes 204 and 206 leaning to the left. The portion 200 has a height 210 of 8 to 12 inches and a length 212 of at least 2 foot. The top 214 of the portion 200 is at least 3 foot above the ground 202.

Figure 7:
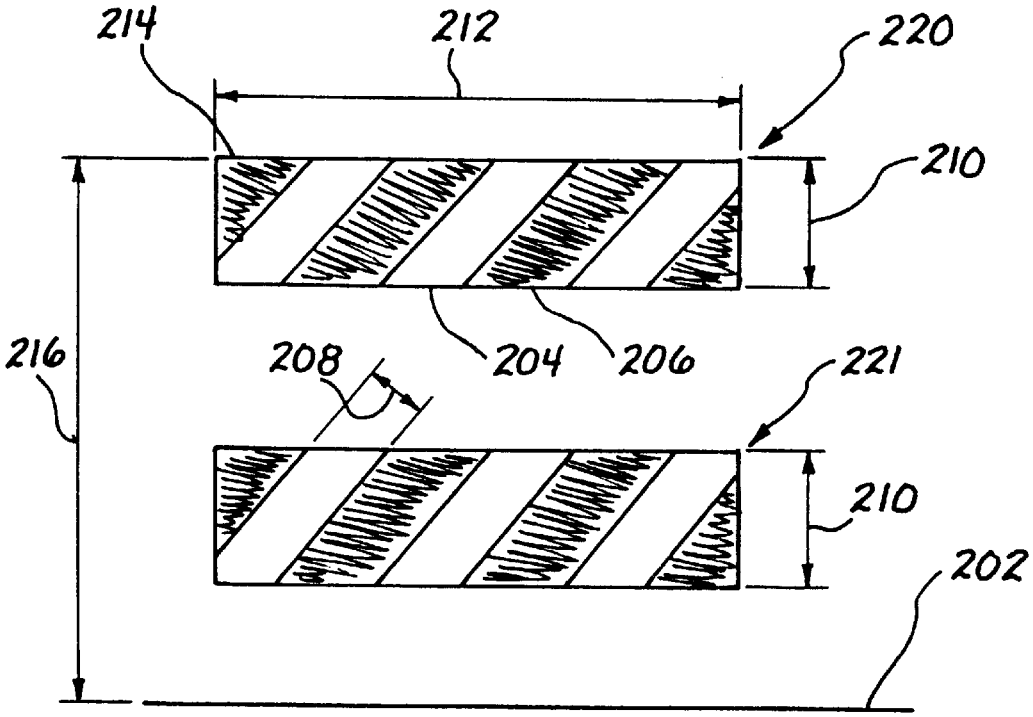

Referring now to FIG. 7, the size and positioning of an upper reflective portion 220 and a lower reflective portion 221 of a Type II barricade is shown relative to the ground 202. The stripes 204 and 206, the stripe width 208, the stripe orientation, the height 210 and the length 212 of each reflective portion 220 and 221 is the same as for the reflective portion 200. The portion 221 is positioned below the portion 220. The top edge 214 of the upper portion 220 is greater than 3 feet from the ground 202.

In embodiments of the invention, the vertical panel has a contact surface that makes contact with the upper surface of the base. In the embodiment of the invention 10 shown in FIG. 1, the contact surface was the portion of the base edge 24 that extended beyond the tab 16. In the embodiment of the invention 100 shown in FIG. 4, the contact surface was the shoulders 135 of the tab 116. In preferred embodiments of the invention, the contact surface has an overall length that is approximately equal to the width of the base at the point of contact. The matching of the vertical panel contact surface length and the base width results in a laterally stable vertical panel system without having a vertical panel with excess material and the resulting higher manufacturing costs. Other, less preferred embodiments of the invention may have a vertical panel contact surface that does not extend across the width of the base. Additionally, other, less preferred embodiments of the invention may have portions of the contact surface extend beyond the width of the base.

Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A vertical multi-panel system comprising:

a. a vertical panel comprising first and second panels, each panel comprising opposing first and second panel surfaces and a plurality of edges comprising a base edge and a top edge;

b. a support member connecting the first and second panels, wherein the first panel has a top edge that is located proximate to the second panel base edge, so that the first panel is disposed below the second panel;

c. a tab extending from the first panel base edge and terminating at a tab bottom edge, the tab comprising two opposing side surfaces extending between two opposing side edges, wherein at least one of the tab side surfaces includes a tab groove extending from the tab bottom edge towards the first panel base edge; and d. a base comprising a top surface and a slot extending from the top surface downwardly through at least a portion of said base, wherein the slot has a shape which complements at least a portion of the tab and the tab groove;

e. said tab being insertable into said slot to releasably attach said vertical panel to said base, such that when said vertical panel system is impacted by a vehicle, said vertical panel detaches and breaks away from said base.

2. The vertical multi-panel system of claim 1, wherein the first and second panels define a plane.

3. The vertical multi-panel system of claim 2, wherein the support member is disposed in the plane defined by the first and second panels and extends between the top edge of the first panel and the base edge of the second panel.

4. The vertical panel system of claim 1, wherein at least a portion of the plurality of edges of either of the first or second panels are raised above a respective first panel surface, said panel edges being unitarily molded with either of said first or second panels, such that said panel edges and said first or second panel do not comprise separate pieces.

5. The vertical multi-panel system of claim 1, wherein at least one of the panel surfaces is recessed.

6. The vertical panel system of claim 1, wherein said first panel is not secured to said base by a bolt and nut combination.

7. The vertical panel system of claim 1, wherein said tab groove does not extend entirely through said tab.

8. A vertical panel system comprising:

a. a vertical panel comprising a first panel with opposing first and second panel surfaces and a plurality of edges, wherein the plurality of edges comprise a base edge and the first and second panel surfaces are recessed, the vertical panel being comprised of double wall blow molded plastic;

b. a tab extending from the panel base edge and terminating at a tab bottom edge, the tab comprising two opposing side surfaces extending between two opposing side edges, wherein the tab side surfaces include a plurality of grooves extending from the tab bottom edge towards the panel base edge, the tab bottom edge being shorter than the panel base edge, said tab further comprising shoulder portions that laterally extend from the tab side edges; and c. a rubber base comprising a top surface and a slot extending from the top surface downwardly into the base, wherein the slot has a shape which complements the tab and the grooves;

d. said tab being insertable into said slot to releasably attach said vertical panel to said base, such that when said vertical panel system is impacted by a vehicle, said vertical panel detaches and breaks away from said base.

9. The vertical panel system of claim 8, wherein the tab portion is disposed in the slot and the tab shoulder portions are in contact with the base top surface.

10. The vertical panel system of claim 8, further comprising reflective sheeting disposed on at least one of the panel surfaces.

11. The vertical panel system of claim 8, wherein the vertical panel system is a Type I barricade or a Type II barricade.

12. A vertical panel system comprising:

a vertical panel having a panel with opposing first and second panel surfaces and a plurality of edges, said plurality of edges including a base edge;

a projection extending from the panel base edge and terminating at a bottom edge of said projection, said projection comprising two opposing faces extending between two opposing side edges;

said projection being fabricated of a molded material, wherein said molded material includes surface irregularities comprising at least one groove molded therein;

a base comprising a top surface and a slot extending downwardly from the top surface into said base, said slot being shaped to complement at least a portion of a shape of said projection and comprising an interior surface, wherein said surface includes surface irregularities which complement the surface irregularities of said projection and the surface irregularities of said projection do not extend entirely through said projection;

said projection being insertable into said slot to releasably attach said vertical panel to said base, such that when said vertical panel system is impacted by a vehicle, said vertical panel detaches and breaks away from said base.

13. The vertical panel system of claim 12, wherein the surface irregularities of said slot comprise at least one ridge which interfits with said at least one groove when said projection is inserted into said slot.

14. The vertical panel system of claim 12, wherein said at least one groove comprises a plurality of adjacent grooves, at least two of which are disposed on each face of said projection.

15. The vertical panel system of claim 14, wherein the surface irregularities of said slot comprise a plurality of ridges disposed on opposing portions of the interior surface of said slot, said ridges being arranged to interfit with corresponding projection grooves when said projection is inserted into said slot.

16. A vertical panel system, comprising:

a. a vertical panel comprising a panel with opposing first and second panel surfaces and a plurality of edges, wherein the plurality of edges include a base edge;

b. a tab extending from said panel base edge and terminating at a tab bottom edge, the tab comprising two opposing side surfaces extending between two opposing side edges, wherein at least one of the tab side surfaces includes a tab groove extending from the tab bottom edge towards the panel base edge, said tab including shoulder portions that laterally extend from the tab side edges; and c. a base comprising a top surface and a slot extending from the top surface downwardly through at least a portion of said base, wherein the slot has a shape which complements at least a portion of the tab and the tab groove;

d. said tab being insertable into said slot to releasably attach said vertical panel to said base, such that when said vertical panel system is impacted by a vehicle, said vertical panel detaches and breaks away from said base.

17. The vertical panel system of claim 16, wherein the tab portion is disposed in the slot and the tab shoulder portions are in contact with The base top surface.

18. A vertical panel system, comprising:

a. a vertical panel comprising a panel with opposing first and second panel surfaces and a plurality of edges, wherein the plurality of edges include a base edge;

b. a tab extending from said panel base edge and terminating at a tab bottom edge, the tab comprising two opposing side surfaces extending between two opposing side edges, wherein at least one of the tab side surfaces includes a tab groove extending from the tab bottom edge towards the panel base edge, but not extending entirely through said tab; and c. a base comprising a top surface and a slot extending from the top surface downwardly through at least a portion of said base, wherein the slot has a shape which complements at least a portion of the tab and the tab groove;

d. said tab being insertable into said slot to releasably attach said vertical panel to said base, such that when said vertical panel system is impacted by a vehicle, said vertical panel detaches and breaks away from said base.

19. The vertical panel system of claim 18, wherein:

a. the tab comprises a plurality of tab grooves extending from the tab bottom edge towards the panel base edge on both tab side surfaces; and b. the shape of the slot complements the shape of the tab portion and the plurality of tab grooves.

20. The vertical panel system of claim 18, wherein:

a. the tab bottom edge extends a length; and b. the panel base edge extends a length that is longer than the tab bottom edge length.

21. The vertical panel system of claim 20, wherein the tab portion is disposed in the slot and a portion of the panel base edge is in contact with the base top surface.

22. The vertical panel system of claim 18, wherein at least a portion of the plurality of edges of the panel is raised above the first panel surface of the panel, said panel edges being unitarily molded with said first panel surface, such that said panel edges and said first panel surface do not comprise separate pieces.

23. The vertical panel system of claim 18, wherein the panel surfaces of the panel are recessed.

24. The vertical panel system of claim 18, wherein the first panel surface is reflective.

25. The vertical panel system of claim 16, wherein the base comprises rubber.

26. The vertical panel system of claim 18, wherein the base comprises a ballast-containing hollow plastic container.

27. The vertical panel system of claim 18, wherein the vertical panel comprises double wall blow molded plastic.

28. The vertical panel system of claim 18, wherein said panel is not secured to said base by a bolt and nut combination.

29. The vertical panel system of claim 18, wherein the tab comprises shoulder portions that laterally extend from the tab side edges.

30. The vertical panel system of claim 29, wherein the tab portion is disposed in the slot and the tab shoulder portions are in contact with the base top surface.

* * * * *